US007347542B2

(12) United States Patent
Nichols et al.

(10) Patent No.: US 7,347,542 B2
(45) Date of Patent: Mar. 25, 2008

(54) APPARATUS AND METHOD FOR WASTE INK DISPOSAL IN SOLID INK JET PRINTER

(75) Inventors: Ronald Larry Nichols, Canandaigua, NY (US); Andrew Wayne Hays, Fairport, NY (US); Scott J. Phillips, West Henrietta, NY (US); Tallam I. Nguti, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 22 days.

(21) Appl. No.: 10/877,301

(22) Filed: Jun. 25, 2004

(65) Prior Publication Data

US 2005/0285917 A1 Dec. 29, 2005

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 4,636,803 A | | 1/1987 | Mikalsen | |
| 4,739,339 A | | 4/1988 | DeYoung et al. | |
| 5,038,157 A | | 8/1991 | Howard | |
| 5,372,852 A | | 12/1994 | Titterington et al. | |
| 5,418,561 A | * | 5/1995 | Fujioka | 347/88 |
| 5,508,722 A | * | 4/1996 | Saito et al. | 347/17 |
| 6,053,608 A | | 4/2000 | Ishii et al. | |
| D453,787 S | | 2/2002 | Mattern | |
| 6,746,113 B1 | | 6/2004 | Leighton et al. | |
| 6,783,221 B2 | * | 8/2004 | Phillips | 347/88 |
| 2003/0081048 A1 | * | 5/2003 | Davis et al. | 347/29 |

FOREIGN PATENT DOCUMENTS

JP 05278229 A * 10/1993

* cited by examiner

*Primary Examiner*—Manish S. Shah
*Assistant Examiner*—Laura E. Martin
(74) *Attorney, Agent, or Firm*—Fay Sharpe LLP

(57) ABSTRACT

A method for disposing of waste ink from an image producing machine (10) is provided. The machine (10) includes a printhead (32) that ejects ink in its liquid form from a face (32*a*) of the printhead (32), the ink being phase change ink existing in liquid form above a melting temperature and in solid form below the melting temperature. The method includes: catching waste ink from the printhead (32) in a gutter (34); heating the gutter (34) to a temperature above the melting temperature; and, flowing the waste ink from the gutter (34) into a collection container (38) where it is allowed to solidify.

7 Claims, 4 Drawing Sheets

APPARATUS AND METHOD FOR WASTE INK DISPOSAL IN SOLID INK JET PRINTER

BACKGROUND

The present inventive subject matter relates to the imaging arts. It finds particular application in conjunction with phase change or solid ink jet image rendering devices, and will be described with particular reference thereto. However, one of ordinary skill in the art will appreciate that it is also amenable to other like applications.

In general, a phase change or solid ink jet printer (or other like image producing or rendering machines, e.g., copiers, fax machines, multi-function devices, etc.) employs inks that are in a solid phase at ambient temperature, but exist in a molten or melted liquid phase at an elevated operating temperature of the printer. At the elevated operating temperature, droplets or jets of the molten or liquid phase ink are ejected from a printhead of the printer onto a printing media. Such ejection can be directly onto a final image receiving substrate, or indirectly onto an imaging member before transfer from it to the final image receiving media. In any case, when the ink droplets contact the surface of the printing media, they solidify to create an image in the form of a predetermined pattern of solidified ink drops.

An example of a phase change ink image producing machine or printer is disclosed in U.S. Pat. No. 5,372,852 issued Dec. 13, 1994 to Titterington, et al., incorporated by reference herein in its entirety. As disclosed therein, the phase change ink printing process includes raising the temperature of a solid form of the phase change ink so as to melt it and form a molten liquid phase ink. It also includes applying droplets of the phase change ink in a liquid form onto an imaging surface in a pattern using a device such as an ink jet printhead. The process then includes solidifying the phase change ink droplets on the imaging surface, transferring them to the image receiving substrate, and fixing the phase change ink to the substrate.

Conventionally, the solid form of the phase change ink is a "stick", "block", "bar" or "pellet" as disclosed for example in U.S. Pat. No. 4,636,803 (rectangular block, cylindrical block); U.S. Pat. No. 4,739,339 (cylindrical block); U.S. Pat. No. 5,038,157 (hexagonal bar); U.S. Pat. No. 6,053,608 (tapered block with a stepped configuration), all incorporated herein by reference in their entirety. Further examples of such solid forms are also disclosed in design patents such as U.S. Pat. No. D453,787 issued Feb. 19, 2002, also incorporated herein by reference in its entirety. In use, each such block form "stick", "block", "bar" or "pellet" is fed into a heated melting device that melts or phase changes the "stick", "block", "bar" or "pellet" into a print head reservoir for printing as described above.

The printhead that ejects or jets the phase change ink is, on occasion, cleaned, e.g., to maintain performance of the printer and preserve image quality. Commonly, during a cleaning cycle, a scraper or wiper blade is drawn across the ink ejecting face of the printhead to squeegee away any excess liquid phase ink that may collect there. The waste ink wiped-off or otherwise removed from the face of the printhead is typically allow to drop (typically, still in liquid from) directly from the printhead into a collection pan or waste container where it cools and re-solidifies. When the collection pan is full, it is removed, manually emptied and then returned.

While generally acceptable, the foregoing approach to waste ink disposal has certain drawbacks and/or limitations. For example, manual emptying of the collection pan may be deemed undesirable in certain circumstances. Being that the collection pan receives the waste ink directly from the printhead, it is often located inside the printer positioned under the printhead. This location potentially complicates the access to and/or removal of the collection pan. In such instance, e.g., because the printer may have to be opened up to access the collection pan, it may not be able to operate at all while the pan is being emptied.

The collection and disposal of waste phase change ink presents certain challenges in general. For example, one challenge is to guard against the waste ink splattering out of the collection pan when it is drop therein from a distance, e.g., in its liquid form. Another challenge is to collect the waste ink so that its level is maintained substantially even as it is being collected. FIG. 1, for example, shows a prior art approach in which the waste ink tends to form stalagmites 200 in a collection pan 202. This phenomena is experienced when ink 204 still in its molten form, but near its freezing point, drips from the printhead 206 onto solid ink 208 already collected, e.g., already at or near ambient temperature. As a result, the ink that is deposited into the waste container or collection pan 202 tends to freeze or re-solidify rather quickly, i.e., before it has had a chance to spread out evenly. Stalagmite growth of this kind is generally undesirable because a build-up may route waste ink into one side of the collection pan or the other, thus resulting in a container that is only partially full, or eventually the top of the stalagmite may reach the inlet to the collection pan and may block it off.

Accordingly, a new and improved apparatus and/or method for disposal of waste ink in a solid ink jet printer is disclosed that overcomes the above-referenced problems and others.

BRIEF DESCRIPTION

In accordance with one exemplary embodiment, a method for disposing of waste ink from an image producing machine is provided. The machine includes a printhead that ejects ink in its liquid form from a face of the printhead, the ink being phase change ink existing in liquid form above a melting temperature and in solid form below the melting temperature. The method includes: catching waste ink from the printhead in a gutter; heating the gutter to a temperature above the melting temperature; and, flowing the waste ink from the gutter into a collection container where it is allowed to solidify.

In accordance with another exemplary embodiment, a system for disposing of waste ink from an image producing machine is provided. The machine includes a printhead that ejects ink in its liquid form from a face of the printhead, the ink being phase change ink existing in liquid form above a melting temperature and in solid form below the melting temperature. The system includes: catching means for catching waste ink from the printhead; heating means for heating the catching means to a temperature above the melting temperature; and, collection means for collecting the waste ink that flows from the catching means into the collection means where it is allowed to solidify.

In accordance with yet another exemplary embodiment, a waste ink disposal apparatus is provided in an image rendering machine. The machine uses a phase change ink that exists in a liquid phase above a melting temperate and in a solid phase below the melting temperature and has a printhead with a face from which ink in its liquid phase is ejected. The waste ink disposal apparatus disposes of waste ink collected in its liquid phase from the face of the printhead.

The waste ink disposal apparatus includes: a gutter that catches waste ink from the face of the printhead; heating means for heating the gutter to a temperature above the melting temperature; and, a collection container for collecting the waste ink that flows from the gutter into the collection container where it is allowed to solidify.

Numerous advantages and benefits of the inventive subject matter disclosed herein will become apparent to those of ordinary skill in the art upon reading and understanding the present specification.

BRIEF DESCRIPTION OF THE DRAWINGS

The present inventive subject matter may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION

Figure 2:
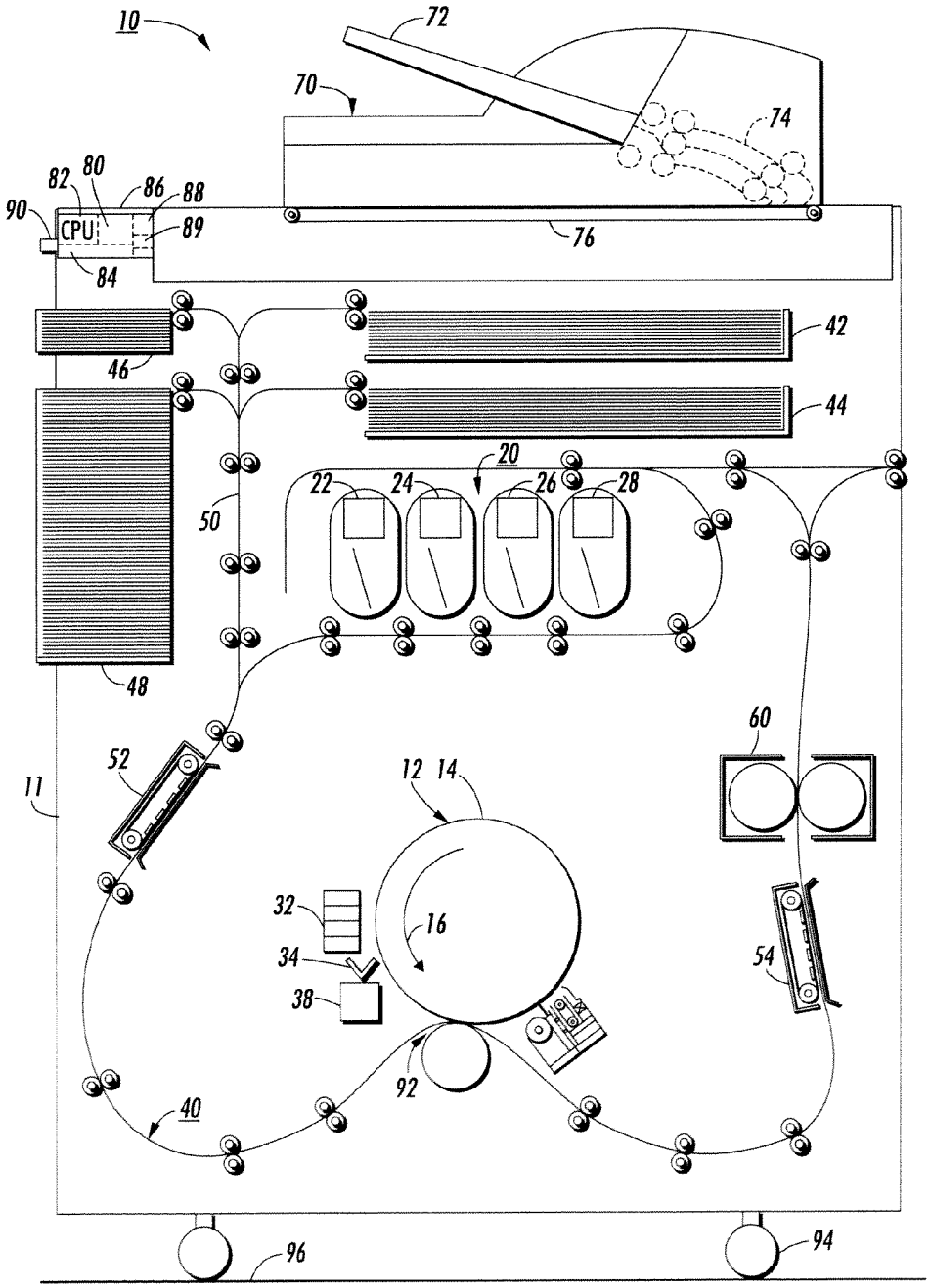
FIG. 2 is a diagrammatic illustration showing an exemplary phase change ink image producing machine including a waste ink disposal system embodying aspects of the present inventive subject matter.

With reference to FIG. 2, there is illustrated an image a phase change or solid ink image producing machine 10. As illustrated, the machine 10 is a copier machine. However, alternately the machine may be a printer, fax machine, multi-function device, or the like. The machine 10 includes a frame or housing 11 to which are mounted directly or indirectly all its operating subsystems and components, as will be described below. The machine 10 also includes an imaging member 12 that is shown in the form of a drum, but alternately it may take the form of a supported belt or the like. The imaging member 12 has an imaging surface 14 that is movable in the direction 16, and on which phase change ink images are formed.

The machine 10 includes a phase change ink system 20 that has at least one source 22 of one color phase change ink in solid form. As illustrated, the machine 10 is a multicolor image producing machine, and the ink system 20 includes, e.g., four (4) sources 22, 24, 26, 28, representing four (4) different colors of phase change inks, e.g., CYMK (cyan, yellow, magenta, black). The phase change ink system 20 also includes a phase change ink melting and control assembly (not shown) for melting or phase changing the solid form of the phase change ink into a liquid form. Thereafter, the phase change ink melting and control assembly then controls and supplies the molten liquid form of the ink towards a printhead system including at least one printhead or printhead assembly 32. Suitably, for a four (4) color multicolor image producing machine, the printhead system includes four (4) separate printhead assemblies, i.e., one for each color. However, for simplicity only one printhead assembly 32 is shown. Optionally, any suitable number of printheads or printhead assemblies may be employed.

Figure 3:
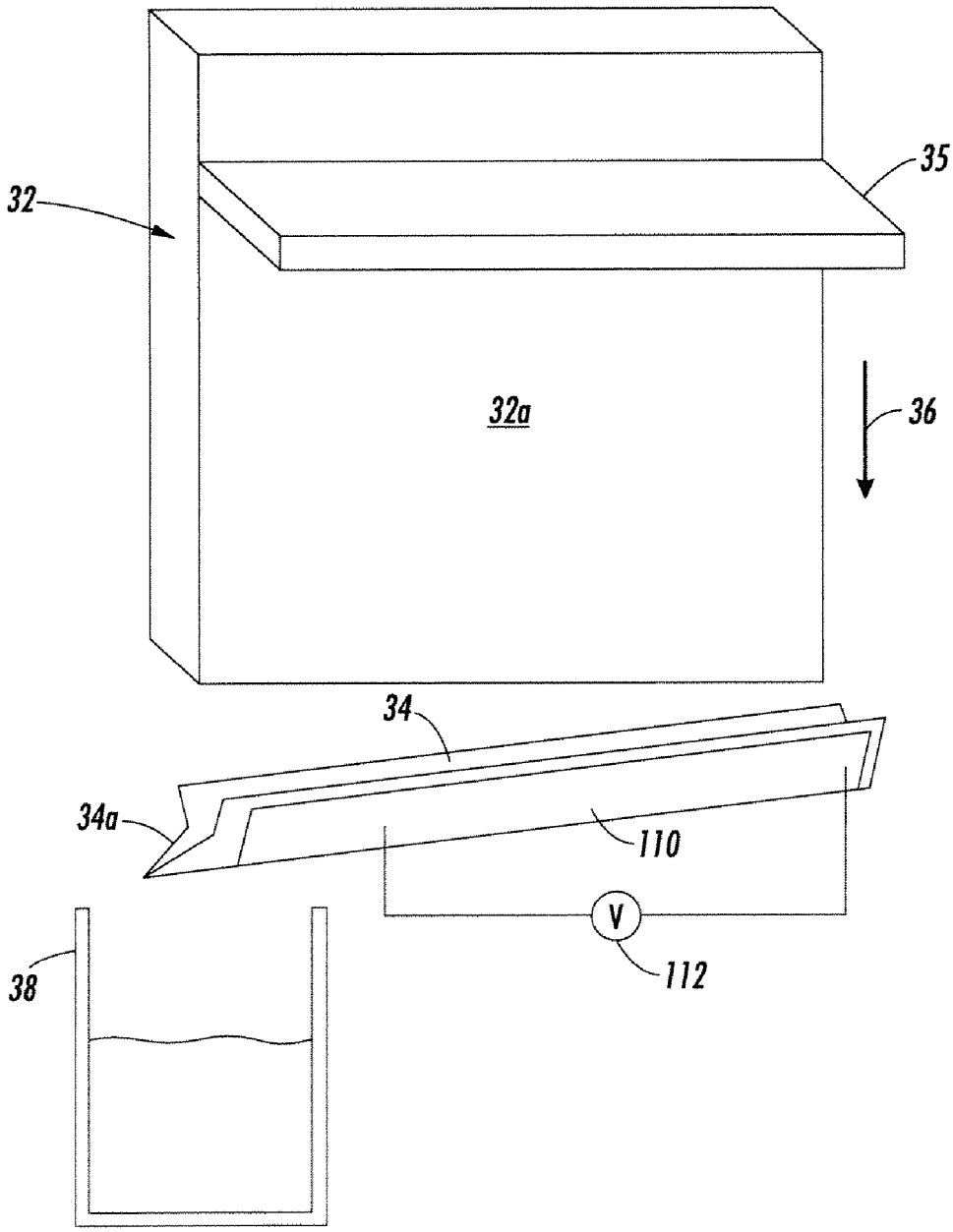
FIG. 3 is a diagrammatic illustration showing an exemplary waste ink disposal system embodying aspects of the present inventive subject matter.

With reference to FIG. 3 and continuing reference to FIG. 2, for use during cleaning cycles, a trough or gutter 34 is positioned below the ink ejecting face 32*a* of the printhead assembly 32. Optionally, a scraper or wiper blade 35 is drawn across (e.g., in the direction indicated by the arrow 36) the ink ejecting face 32*a* of the printhead 32 to squeegee away any excess liquid phase ink that may collect there. The waste ink wiped-off or otherwise removed from the face of the printhead (typically, still in liquid from) is caught by the gutter 34 which ultimately channels or otherwise directs it toward a removable waste ink collection container 38 where, e.g., it is allowed to cool and re-solidify. Suitably, the waste ink collection container 38 is positioned in a location conveniently accessible, e.g., at or near the outside of the main housing 11 of the machine 10. Accordingly, when full, the container 38 is readily removed for emptying. Alternately, the full container 38 may simply be disposed and replaced with a new empty container.

As further shown, the machine 10 includes a substrate supply and handling system 40. The substrate supply and handling system 40 for example includes substrate supply sources 42, 44, 46, 48, of which supply source 48 for example is a high capacity paper supply or feeder for storing and supplying image receiving substrates in the form of cut sheets for example. The substrate supply and handling system 40 also includes a substrate handling and treatment system 50 that has a substrate pre-heater 52, substrate and image heater 54, and a fusing device 60. The machine 10 as shown also include an original document feeder 70 that has a document holding tray 72, document sheet feeding and retrieval devices 74, and a document exposure and scanning system 76.

Operation and control of the various subsystems, components and functions of the machine 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assembly 32. As such, the ESS or controller 80 is the main multi-tasking processor for operating and controlling all of the other machine subsystems and functions, including the machine's printing operations and printhead cleaning operations.

For printing operations, image data for an image to be produced is sent to the controller 80 from either the scanning system 76 or via the online or work station connection 90 for processing and output to the printhead assembly 32. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Figure 4:
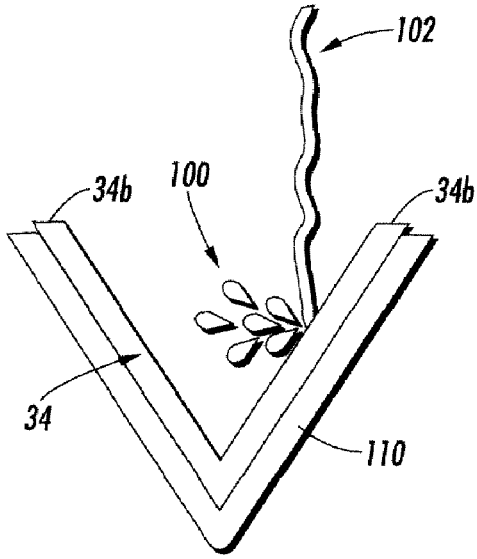
FIG. 4 is a diagrammatic illustration showing a cross-section view of the exemplary gutter shown in FIG. 3.

With reference to FIG. 3, as shown, the gutter 34 is positioned under and substantially centered about the plane in which the ink ejecting face 32*a* of the printhead assembly 32 resides. The gutter 34 extends longitudinally along an entire width of the ink ejecting face 32*a* and is angled or inclined downward with respect to the horizontal (e.g., at approximately a 4 degree angle) toward the waste ink collection container 38 such that ink in its liquid form flows from the gutter 34 into the container 38. In the illustrated embodiment, the gutter 34 also includes a spout 34*a* at the container end and is capped at the opposite end. Suitably, as best seen in FIG. 4, the gutter 34 is formed from a pair of angled side walls 34*b* which together define a v-shaped cross section. Advantageously, the angled side walls 34*b* tend to direct splatters or spray 100 from liquid ink 102 dropping or falling onto the walls 34*b* in a lateral direction so as to contain such splatters or spray 100 in the gutter 34, as opposed to directing them vertically and potentially out of the gutter 34.

As shown in FIGS. 3 and 4, a heater 110 is mount on or in close proximity to the gutter 34. Optionally, the heater 110 extends substantially along the entire length of the gutter 34 and wraps around both walls 34*b* as shown. Alternately, more or less area of coverage on one or both walls 34*b* is provided, and/or a plurality of smaller heaters may be used in place of the heater 110. Suitably, the heater 110 is a resistive heater powered by an electrical power source 112 under the control of a controller, e.g., controller 80. When power is supplied from the source 112, the heater 110 heats the gutter 34 to a selected temperature. Optionally, a thermometer or other temperature sensor (not shown) monitors the temperature of the gutter 34 and provides feedback to the controller 80 which in turn controls the power source 112 accordingly to supply a desired amount of heat to the gutter 34.

In a suitable configuration, the heater 110 may be a thin film Kapton type heater or a Minco Thermafoil Heater (P/N HK5344R40.3L12F) or the like that is cemented or otherwise bonded to the gutter 34. Alternately, other heaters or other types of heat sources may be employed, e.g., an infrared heater.

Figure 1:
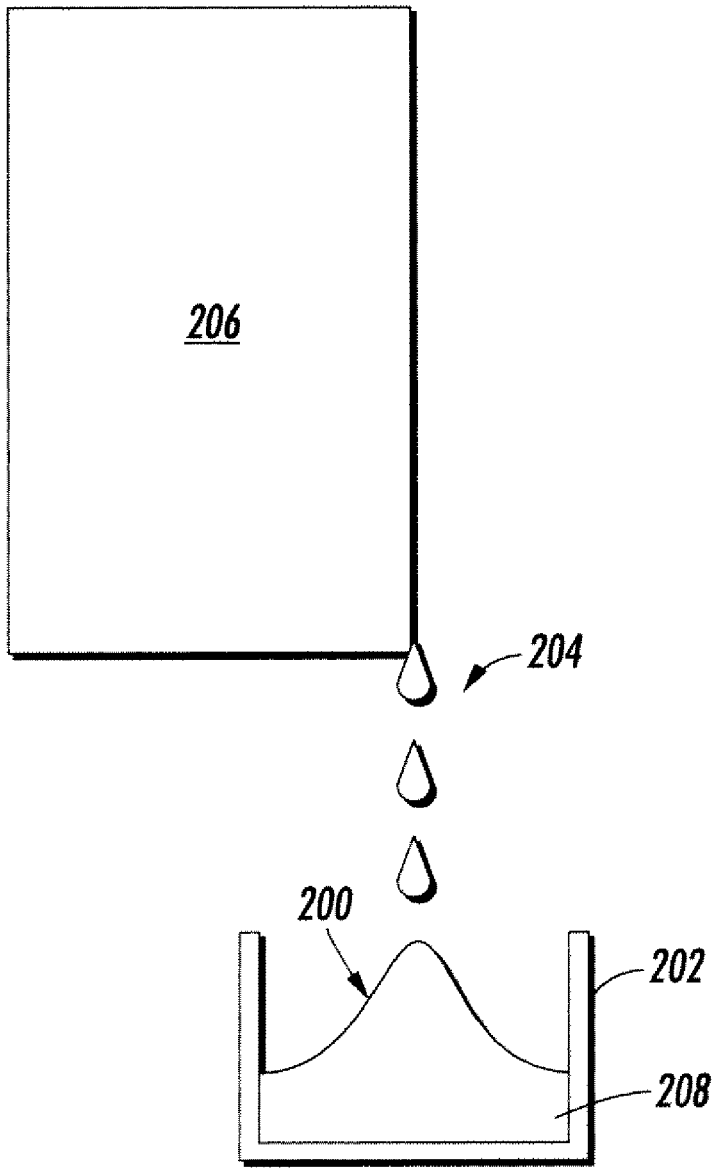
FIG. 1 PRIOR ART
FIG. 1 is a diagrammatic illustration showing stalagmite growth in a collection pan in accordance with prior art waste ink collection.

In one preferred embodiment, the gutter 34 is heated during each cleaning cycle for example to a substantially uniform target temperature. Suitably, the target temperature is sufficiently higher than the melting point of the phase change ink being employed. Accordingly, when the waste ink is caught by the gutter 34 it is heated to and/or maintained in its liquid form at a sufficiently high temperature, i.e., high enough so that after it flows out of the gutter 34 into the collection container 38 it has enough time to spread out substantially even before re-solidifying, thereby reducing the undesirable tendency to grow stalagmites in the collection container 38 (such as those seen in FIG. 1). For example, where the phase change ink being used has a melting temperature of around 95 degrees C., a target gutter temperature of 120 degrees C. is suitable, albeit some uneven growth may still be observed in the collection container 38, but it remains acceptable. Preferably, in this example, the target gutter temperature is 143 degrees C., where little to no uneven growth is observed. In this example, using over 150 degree C. for the target gutter temperature achieves no significant improvement in performance. The higher power usage is therefore not justified to achieve the present goal. Accordingly, in this example, the target gutter temperature is in the range of 120 to 150 degrees C. depending on the performance desired and the amount of power one desires to expend. Of course, where the melting temperature of the phase change ink varies from 95 degrees C., the target gutter temperature and/or suitable ranges therefore will also vary, for example, proportionately.

In another suitable embodiment, the waste ink from one or more cleaning cycles is allowed to accumulate and re-solidify in the gutter 34, e.g., which may be at ambient temperature when it catches the waste ink. Periodically or as otherwise selected, the gutter 34 is heated by the heater 110 which in turn re-liquefies the accumulated waste ink in the gutter 34 such that it is free to flow therefrom into the collection container 38. With this approach, however, certain issues may arise. For example, when the gutter 34 is heated, the outer portions of waste ink nearest the walls 34*b* may tend to re-liquefy before inner portions which may then slide in solid or semi-solid form down the slope of the gutter 34. This can lead to undesirable results, e.g., solid chunks of ink clogging the inlet to the collection container 38 or falling off the gutter 34. In addition, thermal expansion of the solid waste ink being heated from one side may cause slabs thereof to curl up away from the gutter's floor, possibly spilling over the side of the gutter 34 when finally melted. Notably, the geometry of the v-shaped cross section may tend to guard against the curling problem. However, other heating techniques are also optionally employed to control re-liquefaction of the solid waste ink accumulated in the gutter 34 for example to achieve a desirable flow out of the gutter 34 into the collection container 38. Suitably, heat is applied to the gutter 34 in a differential or non-uniform manner for example such that a temperature gradient is developed or to heat different sections of the gutter 34 at different times or at different rates.

In one embodiment, gradient heating is applied longitudinally across the gutter 34. Suitably, the spout end of the gutter 34 has more heat applied thereto or is otherwise heated at a greater rate than the capped end such that the solid waste ink at the spout end melts faster than at the capped end. In this manner, the ink melts faster toward the spout end and begins flowing from the gutter 34 into the collection container 38 progressively earlier than the solid waste ink located toward the capped end. Melting the ink progressively from the spout end of the gutter 34 toward the capped end of the gutter 34 promotes desirable drainage characteristics. Optionally, the gradient heating is achieved by utilizing a continuous heater such as the heater 110 in conjunction with a single power source 112, with the heater 110 having different heating density zone ranging from relatively higher toward the spout end of the gutter 34 to relatively lower toward the capped end of the gutter 34.

Figure 5:
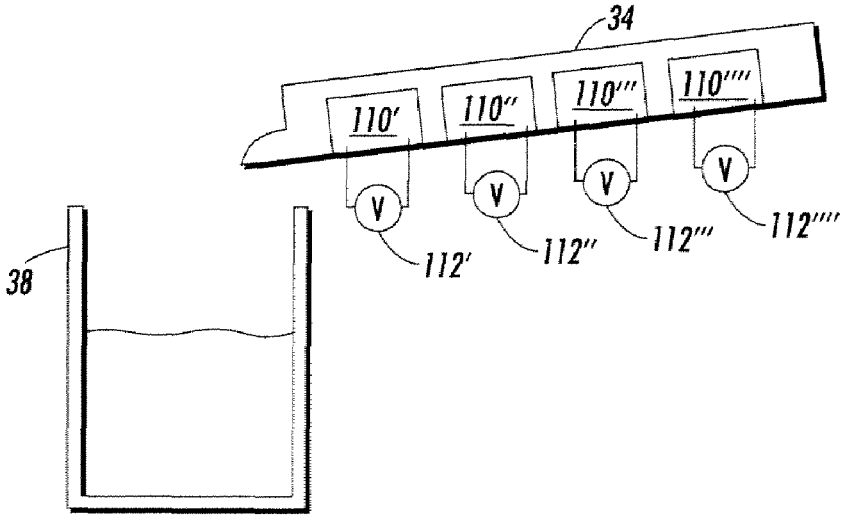
FIG. 5 is a diagrammatic illustration showing an alternate exemplary heating element arrangement embodying aspects of the present inventive subject matter.

As shown in FIG. 5, a plurality of separate heaters are arranged longitudinally along the gutter 34, optionally, each with its own power source 112', 112", 112''', 112''''. Suitably, in a first alternative, the solid waste ink is melted progressively from the spout end of the gutter 34 to the capped end by progressively energizing the heaters 110 successively one after the other in the same order. For example, the heater 110' situated closest to the spout end of the gutter 34 is supply power from its power source 112' first. After a sufficient delay (e.g., once the ink in the vicinity of the heater 110' has melted and/or begun flowing), the second heater 110" is supply power from its power source 112", and so on for the remaining pairs of heaters and power sources. In a second alternative, to achieve the desired progressive melting, the heater/supply pair 110'/112' has a heating density higher than the heater/supply pair 110"/112" which has a heating density higher than the heater/supply pair 110'''/112''' which has a heating density higher than the heater/supply pair 110""/112"", and they are all turned on simultaneously.

Optionally, in the foregoing second alternative, one power supply powers all of the heaters. Optionally, in the foregoing first alternative, the heater and power supply pairs may have the same heating density or may have appropriately different heating densities to achieve the desired melting pattern. Alternately or in addition, variable or differential heating is applied vertically in the same or similar manner as the variable or differential longitudinal heating described. In the case of vertical differential heating, suitably the solid waste ink is melted progressively from the top down, i.e., in the direction of arrow 36 (see FIG. 3). Suitably, with both the longitudinal and/or vertical differential heating, the molten waste ink is again ultimately heated to a temperature which promotes substantially even spreading within the collection contain 38 prior to re-solidification.

In connection with the particular exemplary embodiments presented herein, certain structural and/or function features are described as being incorporated in particular embodiments. It is to be appreciated that different aspects of the exemplary embodiments may be selectively employed as appropriate to achieve other alternate embodiments suited for desired applications, the other alternate embodiments thereby realizing the respective advantages of the aspects incorporated therein.

Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the inventive subject matter be construed as including all such modifications and alterations insofar as they come within the scope of the appended claims or the equivalents thereof.

The invention claimed is:

1. A method for disposing of waste ink from an image producing machine including a printhead that ejects ink in its liquid form from a face of the printhead, said ink being phase change ink existing in liquid form above a melting temperature and in solid form below the melting temperature, said method comprising:

(a) catching waste ink from the printhead in a gutter;

(b) heating the gutter to a temperature above the melting temperature, wherein said heating includes heating different portions of the gutter at different times; and, (c) flowing the waste ink from the gutter into a collection container where it is allowed to solidify.

2. The method of claim 1, further comprising:

squeegeeing waste ink from the face of the printhead such that it drops into the gutter.

3. The method of claim 1, wherein the waste ink is in liquid form when caught by the gutter and it is allowed to re-solidify and accumulate in the gutter before the gutter is heated in step (b).

4. The method of claim 1, wherein the gutter is an elongated trough including opposing first and second ends, said first end being proximate to the collection container and said second end being distal to the collection container, and wherein step (b) is carried out such that accumulated solid ink in the gutter is re-liquefied progressively from the first end of the gutter to the second end of the gutter.

5. A system for disposing of waste ink from an image producing machine including a printhead that ejects ink in its liquid form from a face of the printhead, said ink being phase change ink existing in liquid form above a melting temperature and in solid form below the melting temperature, said system comprising:

catching means for catching waste ink from the printhead;

heating means for heating the catching means to a temperature above the melting temperature, wherein the heating means heats a first portion of the catching means at a first time and heats a second portion of the catching means different from the first portion at a second time different from the first time; and, collection means for collecting the waste ink that flows from the catching means into the collection means where it is allowed to solidify.

6. The system of claim 5, further comprising:

wiper means for wiping waste ink from the face of the printhead such that it drops into the catching means.

7. In an image rendering machine using a phase change ink that exists in a liquid phase above a melting temperate and in a solid phase below the melting temperature and having a printhead with a face from which ink in its liquid phase is ejected, a waste ink disposal apparatus for disposing of waste ink collected in its liquid phase from the face of the printhead, said waste ink disposal apparatus comprising:

a gutter that catches waste ink from the face of the printhead;

heating means for heating the gutter to a temperature above the melting temperature, said heating means including a first heater arranged proximate a first location and a second heater arranged proximate a second location, wherein the heating means is operated such that the first heater is energized before the second heater; and, a collection container for collecting the waste ink that flows from the gutter into the collection container where it is allowed to solidify.

* * * * *